US005435658A

United States Patent [19]

Hasegawa

[11] Patent Number: 5,435,658

[45] Date of Patent: Jul. 25, 1995

[54] EXCHANGEABLE TAPE UNIT

[75] Inventor: Katsunori Hasegawa, Kasugai, Japan

[73] Assignee: Brother Kogyo Kabushiki Kaisha, Aichi, Japan

[21] Appl. No.: 262,440

[22] Filed: Jun. 20, 1994

[30] Foreign Application Priority Data

Jun. 25, 1993 [JP] Japan ..... 5-179862

[51] Int. Cl.[6] ..... B41J 31/05

[52] U.S. Cl. ..... 400/241; 400/208; 428/207

[58] Field of Search ..... 503/200, 201; 400/208, 400/615.2, 120.03, 120.04, 586, 241, 241.1, 241.2; 430/200; 428/40, 207; 346/135.1

[56] References Cited

U.S. PATENT DOCUMENTS 4,377,050 3/1983 Renholts ..... 428/40
5,009,530 4/1991 Kuzuya et al. ..... 400/615.2
5,049,472 9/1991 Hosono et al. ..... 430/200
5,160,206 11/1992 Haftman et al. ..... 400/208
5,163,764 11/1992 Falconeri et al. ..... 400/208
5,193,919 3/1993 Godo et al. ..... 400/615.2
5,203,951 4/1993 Hattori et al. ..... 400/613

*Primary Examiner*—Edgar S. Burr
*Assistant Examiner*—John S. Hilten
*Attorney, Agent, or Firm*—Oliff & Berridge

[57] ABSTRACT

An exchangeable tape unit having a tape spool and a printing tape wound over the tape spool. The printing tape can be prevented from being exposed to light, and the exchangeable tape unit being capable of maintaining stabilized quality for long duration without color change and quality change in a heat sensitive coloring layer formed in the printing tape, and being capable of facilitating storage. The heat sensitive coloring layer constituting the printing tape is positioned radially inwardly when winding the tape over a tape spool. Film sheets are affixed to upper and lower faces of a resultant tape roll of the printing tape.

14 Claims, 3 Drawing Sheets

EXCHANGEABLE TAPE UNIT

BACKGROUND OF THE INVENTION

The present invention relates to an exchangeable tape unit to be assembled in a tape cassette and in which a heat sensitive printing tape is wound over a tape spool, and more particularly, to such tape unit in which heat sensitive coloring layer of the heat sensitive printing tape is positioned radially inwardly when winding the tape over the tape spool.

Conventionally, a tape cassette used for a tape printer accommodates therein a printing tape on which characters etc. are printed by means of a thermal head etc. When the printing tape is used up, a new roll of a printing tape is exchangeable with the used-up roll. Various proposals have been made on such tape cassettes by the applicant. The exchange of the printing tape is generally achieved by exchanging the tape spool and the tape wound thereover as one unit on the tape cassette.

Further, in the conventional tape printer, a thermal head is positioned outside of the contour of the tape cassette. The thermal head is generally adapted for printing an image on an image receiving medium such as a paper by selectively heat-driving a plurality of heat generating elements.

For printing the image on the tape, the heat generating elements of the thermal head are in contact with the outer side of the printing tape fed from the tape cassette. Accordingly, the heat sensitive coloring layer of the printing tape is generally positioned radially outwardly in an exchangeable roll of the tape wound over the tape spool.

However, in the above described conventional exchangeable tape roll, the heat sensitive coloring layer is exposed to outside, since the printing tape is wound over the tape spool in such a manner that the heat sensitive coloring layer is positioned radially outwardly in the resultant roll. Regarding the tape cassette, it provides a window for visually acknowledging a remaining amount of the tape. Thus, light easily enters the interior of the tape cassette through the window. Moreover, various kinds of the printing tapes are prepared in terms of width and color, etc. A user may exchange the tape roll with another kind of the tape roll even if the tape roll has not yet been used up. Thus, the removed tape roll is exposed to light unless it is stored in a dark place.

The heat sensitive coloring layer is very likely affected by external light, heat, etc. Accordingly, if the heat sensitive coloring layer of the printing tape is exposed to outside, color change and quality change may occur in the exposed portion of the layer. Therefore, storage of the exchangeable tape and the spool incurs difficulty, and printing quality may be degraded unless the tape is stored in a severe condition.

If the printing tape is exposed to external light, heat, etc., a boundary is generated between the color changed zone and unchanged zone in the heat sensitive coloring layer. Further, the heat sensitive coloring layer generates color when frictionally contacting with other article. Thus, the exchangeable printing tape roll whose heat sensitive coloring layer is exposed to light, etc. may excessively lower the sales value.

SUMMARY OF THE INVENTION

The present invention is established to overcome the above described conventional drawbacks, and it is an object of the present invention to provide an exchangeable tape unit capable of preventing the heat sensitive coloring layer from being exposed to light by winding the printing tape over the tape spool in such a manner that the heat sensitive coloring layer is positioned radially inwardly, thereby maintaining stabilized quality for long duration without color change and quality change in the heat sensitive coloring layer and facilitating storage.

To attain the above described object, the prevent invention provides an exchangeable tape unit including a tape spool and a printing tape wound over the spool for providing a tape roll. The printing tape has a base tape, a heat sensitive coloring layer formed on one surface of the base tape, and a peelable tape formed on an opposite surface of the base tape through an adhesive agent. The heat sensitive coloring layer is positioned radially inwardly in respective tape windings of the tape roll. Film sheets are preferably affixed to upper and lower faces of the tape roll.

In another aspect of the present invention, there is provided a tape cassette including a tape cassette body, a cassette lid and an exchangeable tape unit. The tape cassette body has a bottom wall, front and rear walls and side walls. A tape spool accommodating portion is defined in a space defined by the walls and, a top open end is defined by the front, rear and side walls. The cassette lid covers the top open end of the tape cassette body. The above described exchangeable tape unit is placeable at the tape spool accommodating portion.

In the present invention, the thus constructed, if the printing tape wound over the spool and accommodated in the tape cassette is used up, the used-up spool is replaced by a new tape unit having a new printing tape and a spool. In this case, since the heat sensitive coloring layer of the printing tape is positioned radially inwardly in the new tape roll, the heat sensitive coloring layer can be protected against external light, heat, etc. during storage of the tape unit. Thus, the newly accommodated tape can exhibit excellent printing quality. Further, if the user wishes to change the printing color, another kind of the tape unit must be used instead of the presently used tape unit. In this case, even if the presently used tape unit is removed from the tape cassette, the removed tape unit is again usable without particular color change and quality change, since the heat sensitive coloring layer is protected against light, heat, etc. because of the internally winding arrangement in respect of the heat sensitive coloring layer.

DETAILED DESCRIPTION OF THE PREFERRED EMBODIMENTS

Figure 1:
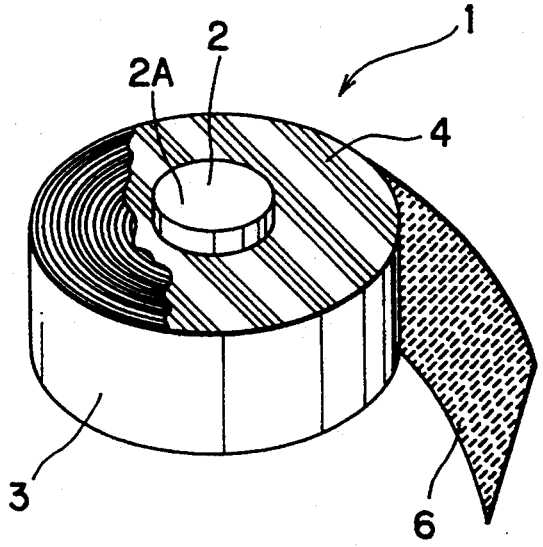
FIG. 1 is a perspective view showing an exchangeable tape unit.

An exchangeable tape unit according to one embodiment of this invention will be described in detail with reference to the drawings, the tape unit being used for a tape printer. First, the exchangeable tape unit of the illustrated embodiment will be described with reference to FIGS. 1 and 2. The exchangeable tape unit 1 includes a tape spool 2, a printing tape 3 wound over the tape spool 2, and film sheets 4 affixed to upper and lower faces of a tape roll (FIG. 1 only shows the upper film sheet 4).

The tape spool 2 has a shaft portion (not shown) around which the printing tape 3 is wound, and a head portion 2A provided integrally with the shaft portion and having a diameter greater than that of the shaft portion.

Figure 2:
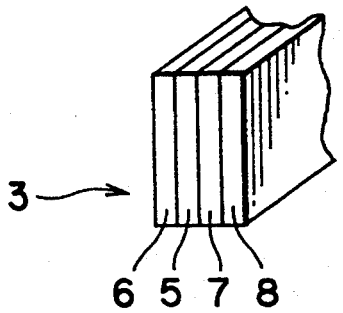
FIG. 2 is an explanatory diagram showing a structure of a printing tape.

As shown in FIG. 2, the printing tape 3 includes a base tape 5 formed of polyester film, a heat sensitive coloring layer 6 formed on one surface of the base tape 5 for generating characters etc. upon thermal coloring by means of heat generating elements of a thermal head TH (described later), and a peelable paper 8 formed on opposite surface of the base tape 5 through an adhesive layer 7. The thus constructed printing tape 3 is wound around the tape spool 2 in such a manner that the heat sensitive coloring layer 6 is positioned radially inwardly as shown in FIG. 1. Thus, the heat sensitive coloring layer 6 of the printing tape 3 is not exposed to outside, so that the heat sensitive coloring layer 6 does not undergo unwanted influence from the external heat, light, etc. to thus avoid color change and quality change of the layer.

Further, a rolled printing tape 3 around the tape spool 2 has upper and lower surfaces to which film sheets 4 are affixed. That is, each of the film sheets has one surface coated with adhesive agent, and the film sheets are bonded to the upper and lower surfaces of the tape roll through the adhesive agent. The film sheets are adapted to prevent the printing tape 3 from being unwound from the tape spool 3 as well as to protect the upper and lower faces of the tape roll against the external heat, light, etc. Accordingly, the printing tape 3 can be almost completely protected against external heat, light, etc., by the film sheets 4 and by the internally winding of the heat sensitive coloring layer 6.

Figure 3:
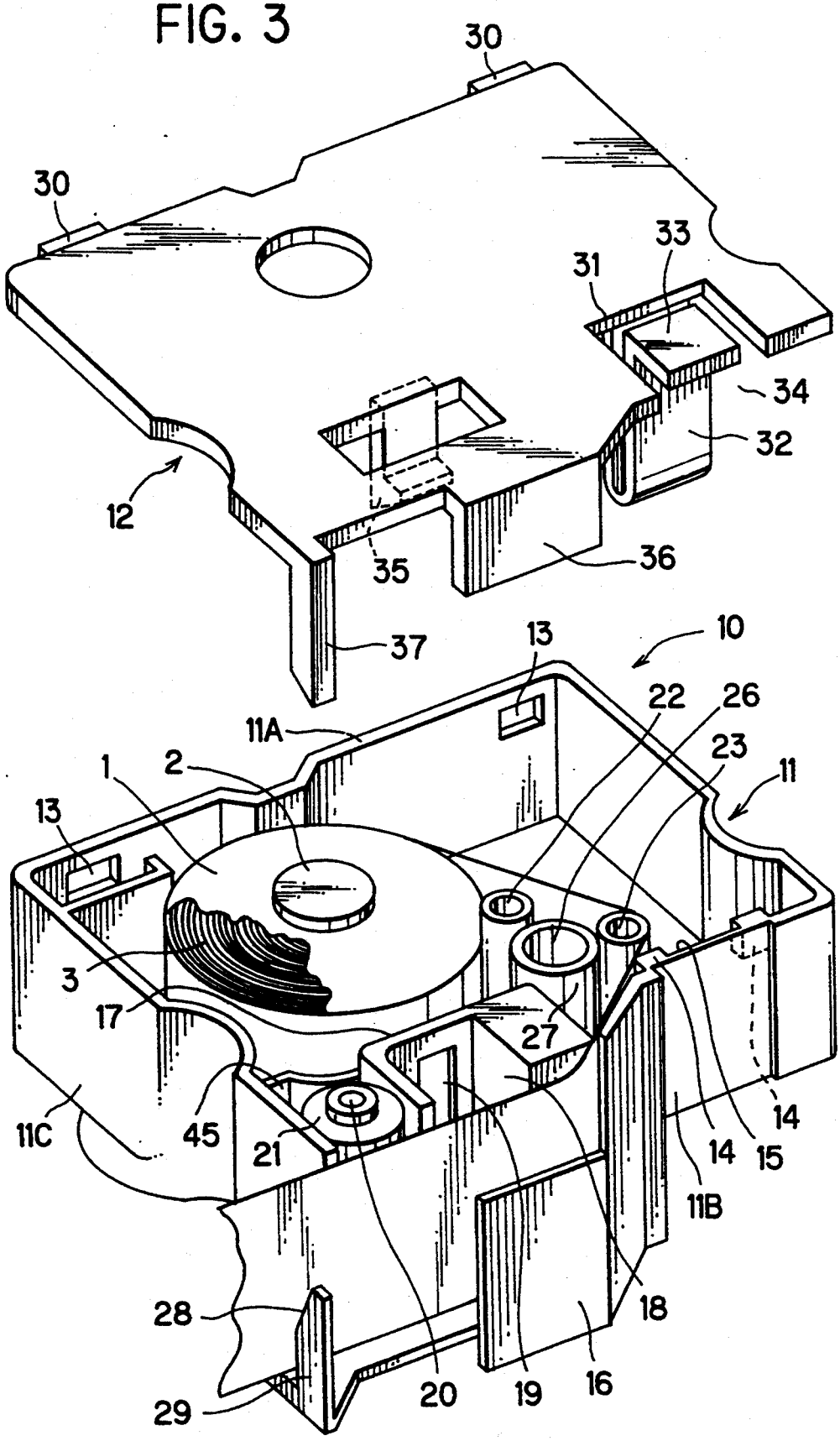
FIG. 3 is an exploded perspective view showing a tape cassette.

Next, will be described a construction of the tape cassette which accommodates therein the exchangeable tape unit 1. In FIG. 3, the tape cassette 10 generally includes a tape cassette body 11 and a cassette lid 12 provided detachably from the cassette body 11. The tape cassette body 11 has a parallelepiped or rectangular casing whose upper side is open. The cassette body 11 has a rear wall 11A where is formed a pair of locking hole 13 at both sides. Each of the locking holes 13 are adapted to receive each locking projection 30, described later, of the cassette lid 12.

The tape cassette body 11 has a front wall 11B where a pair of projections 14 are provided at one side (right side in FIG. 3). A locking groove 15 is defined between the projections 14 and 14. A resilient locking member 34, described later, of the cassette lid 12 is engageable with the locking groove 14. Further, a tape guide piece 16 is provided integrally with the front wall 11B at its left side in FIG. 3. Behind the tape guide piece 16, a thermal head guide member 17 is provided. The thermal head guide member 17 has U-shape in a plan view to define a recess 18 in which the thermal head TH can be positioned. The guide member 17 has a rear wall where a locking slot 19 is formed. A locking segment 35, described later, of the cassette lid 12 is engageable with the locking slot 19. Further, a space 45 is defined between the thermal head guide member 17 and a left side wall 11C of the tape cassette body 11. In the space 45, can be positioned a tape feed roller 21 engageably disposed around a roller drive shaft 20 extending from a bottom wall of a cassette installing portion of the tape printer and rotatably driven by a tape feed motor(not shown). Incidentally, since the structure of the cassette installing portion of the tape printer is known, detailed explanation thereof is negligible.

A tape spool accommodating portion 42 (see FIG. 4) is provided at a rear left side of the tape cassette body 11 for accommodating the above described exchangeable tape unit 1. The exchangeable tape unit 1 is rotatably accommodated in the tape spool accommodating portion 42. Four tape guides 22, 23, 24, 25 (see FIG. 4 for the tape guides 24, 25) extend from the bottom wall of the tape cassette body 11 for guiding the printing tape 3 to the thermal head guide member 17.

Figure 4:
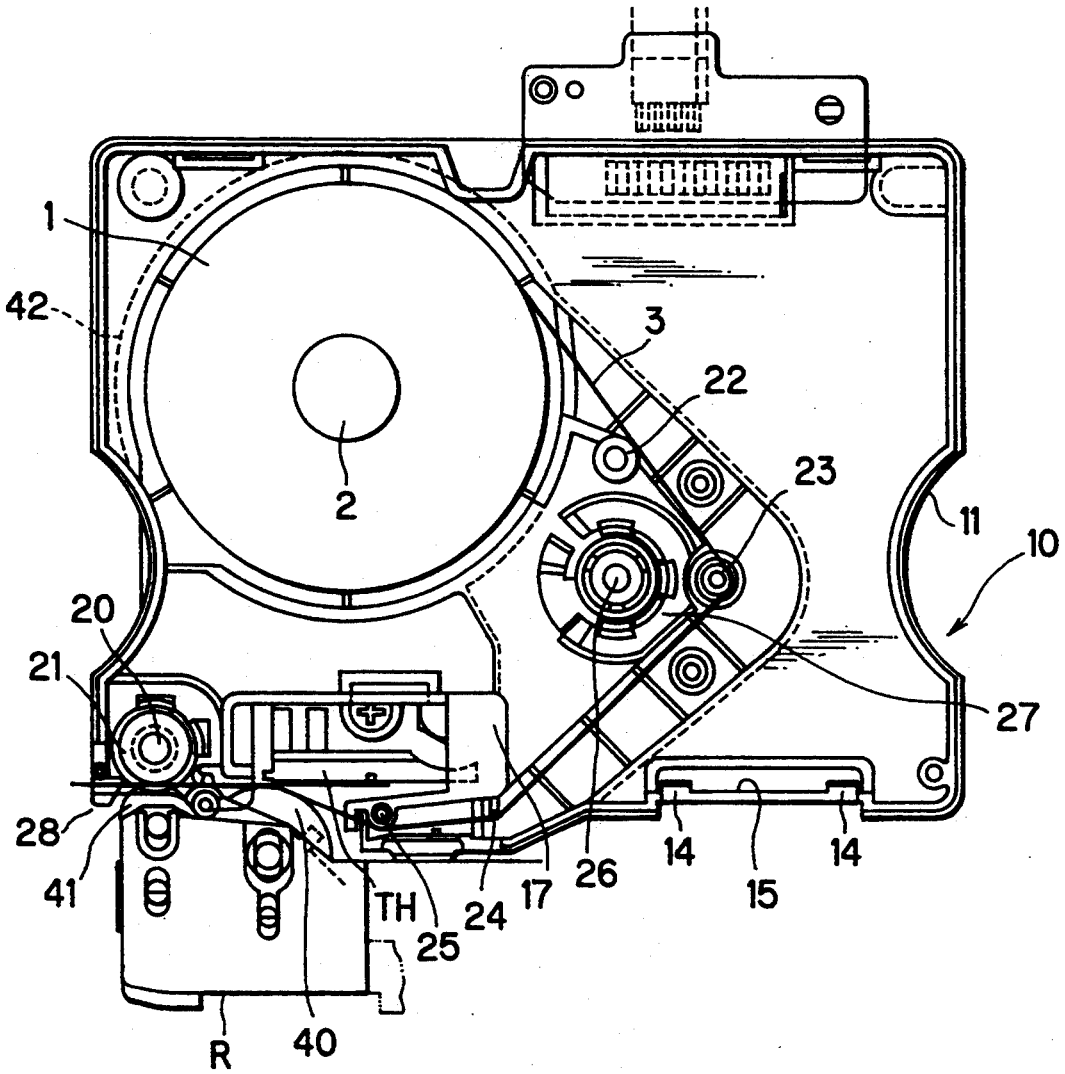
FIG. 4 is a plan view showing a state where the tape cassette is installed in a cassette installing portion of a tape printer, while omitting a cassette lid.

As shown in FIG. 4, the combination of the tape guides 22 through 25 provides a curved path, up to the thermal head guide portion 17, of the printing tape 3 in such a manner that the heat sensitive coloring layer 6 is positioned inwardly relative to the curve. Further, since the printing tape 3 fed from the tape spool 2 is wound thereover in such a manner that the heat sensitive coloring layer 6 is positioned radially inwardly relative to the tape roll. Therefore, the printing tape naturally has a curling nature such that the heat sensitive coloring layer 6 is positioned inwardly relative to the curl. Since the curving direction of the printing tape path defined by the tape guides 22 through 25 is coincident with the curling direction of the printing tape 3, the printing tape 3 can be easily positioned along the tape guides 22 through 25 when placing the tape unit 1. Further, during printing, the printing tape 3 can be smoothly fed to the thermal head TH through the tape guides 22 through 25.

Conventionally, a drive shaft of the tape printer extends from the bottom wall of the cassette installing portion at a position adjacent to the tape guide 23 for taking up a thermal ribbon accommodated in the conventional tape cassette. However, in the tape cassette of the illustrated embodiment, the drive shaft 26 is not adapted to feed the printing tape 3. Therefore, a silencer spool 27 is fitted with the drive shaft 26 so as to reduce noise generated by the rotation of the drive shaft 26. Further, in the tape cassette body 11, a tape outlet portion 28 is provided at a position adjacent a tape fed roller 21. The tape outlet portion 28 is provided by a space defined between a left side of the front wall 11B of the tape cassette body 11 and a guide piece 29 upstanding from a left side wall 11C of the tape cassette body 11. With the structure, the printing tape 3 supplied from the tape spool 2 is fed to the thermal head TH by way of the tape guides 22 through 25, and color images such as characters are printed on the heat sensitive coloring layer 6 through the thermal head TH. The thus printed tape 3 is discharged outside of the tape cassette 10 through the tape outlet portion 28.

Then, the peelable tape 8 of the discharged printing tape 3 is peeled off, and the tape is affixed to a desired location with the heat sensitive coloring layer 6 facing up. In this case, the discharged printing tape 3 undergoes curling in such a manner that the heat sensitive coloring layer 6 is positioned inwardly in the curl, and the peelable tape 8 is positioned outwardly. Accordingly, the peelable tape 8 can be easily removed or peeled off in comparison with the case where the heat sensitive coloring layer 6 is positioned outwardly and the peelable tape is positioned inwardly in the curl.

Further, since the heat sensitive coloring layer 6 and the peelable tape 8 are positioned inwardly and outwardly, respectively in the curl of the printing tape 3, the printing tape can be easily affixed to the desired location. That is, for affixing the printing tape, after the peelable tape 8 is partly peeled from one end of the tape 3, the peeled-off area of the tape 3 is affixed to the desired location, and the printing tape can be successively affixed to the desired location while the peelable tape 8 is gradually peeled off.

Next, will be described the cassette lid 12 provided detachably to the tape cassette body 11. The cassette lid 12 is adapted to cover the top open end of the tape cassette body 11. A rear end of the cassette lid 11 is provided with the pair of locking projections 30, 30 engageable with the locking holes 13 formed in the tape cassette body 11. A recessed portion 31 is formed at a right front end of the cassette lid 12 in which is positioned a resilient locking member 34 including a bent portion 32 integrally suspending from the bottom of the cassette lid 12 and a nipping portion 33 integrally extending in horizontal direction from the bent portion 32. The resilient locking member 34 is resiliently engageable with the locking groove 15. Further, the front left portion of the cassette lid 12 has a locking segment 35 suspending from the bottom surface of the cassette lid 12. The locking segment 35 is resiliently engageable with the locking slot 19 formed in the rear wall of the thermal head guide member 17.

A tape guide piece 36 is suspended from the left front end of the cassette lid 12 for guiding running movement of the printing tape 3 in co-operation with the tape guide piece 16 of the tape cassette body 11 when the cassette lid 12 is assembled to the tape cassette body 11. Further, the guide piece 37 is suspended from the left corner of the cassette lid 12 for defining the tape outlet portion 28 in co-operation with the guide piece 29 of the cassette body 11 when the cassette lid 12 is assembled to the tape cassette body 11.

For assembling the cassette lid 12 to the tape cassette body 11 to provide the tape cassette 10, first, the locking projections 30 of the cassette lid 12 is inserted into the respective locking holes 13 of the tape cassette body 11. Thereafter, the cassette lid 12 is angularly downwardly rotated about the locking holes 13, so that the bent portion 32 of the resilient locking member 34 is resiliently engaged with the locking groove 15 and at the same time, the locking segment 35 is resiliently engaged with the locking slot 19. Accordingly, the cassette lid 12 is engaged with the tape cassette body 11 with a clicking sound to complete assembly of the tape cassette 10.

On the other hand, for detaching the cassette lid 12 from the tape cassette body 11, the nipping portion 33 of the resiliently locking member 34 of the cassette lid 12 is nipped by fingers and is pulled upwardly. By the pulling action, the bent portion 32 and the locking segment 35 are disengaged from the locking groove 15 and the locking slot 19, respectively, so that the cassette lid 12 can be angularly rotatable about the locking holes 13 relative to the tape cassette body 11. Thereafter, the nipping portion 33 is further pulled upwardly, so that the cassette lid 12 is upwardly pivoted about the locking holes 13. If the locking projections 30 are removed from the locking grooves 13 at a proper position, the cassette lid 12 can be removed from the tape cassette body 11.

Next, will be described the installing state of the tape cassette 10, the thus constructed, into the tape printer with reference to FIG. 4. FIG. 4 shows a state where the tape cassette 10 is installed in the cassette installing portion of the tape printer, with omitting the cassette lid 12.

In FIG. 4, when the tape cassette 10 is installed in the cassette installing portion of the tape printer, the thermal head TH fixed to the cassette installing portion is brought to be positioned in the recess 18 of the thermal head guide member 17. Thus, the thermal head TH is positioned interior of the tape cassette 10 in such a manner that the plurality of the heat generating elements of the thermal head TH confront the tape guide pieces 16 and 36. Thus, the heat generating elements are in direct contact with the heat sensitive coloring layer 6, since the printing tape 3 is wound over the tape spool 2 in such a manner that the heat sensitive coloring layer 6 is positioned radially inwardly.

Further, in the cassette installing portion, a roller holder R is angularly movably disposed at a position in confrontation with the thermal head TH and the tape feed roller 21. In the roller holder R, a platen roller 40 is rotatably supported at a position in confrontation with the thermal head TH. Further, a supplemental tape feed roller 41 is also rotatably supported in the roller holder R at a position in confrontation with the tape feed roller 21. Upon operation of the tape printer, the platen roller 40 and the supplemental tape feed roller 41 are in nipping relation to the thermal head TH and the tape feed roller 21, respectively. Thus, the printing tape 3 leading from the tape spool 2 of the tape unit 1 accommodated in the tape accommodating portion 42 of the tape cassette body 11 is smoothly guided through the tape guides 22 through 25 because of the co-operation of the tape feed roller 21 and the supplemental tape feed roller 41, and the printing tape can undergo printing with characters etc. on the heat sensitive coloring layer 6 by the co-operation of the platen roller 40 and the thermal head TH. Thereafter, the printing tape printed with the characters etc. is discharged outside of the tape printer through the tape outlet portion 28 by the co-operation of the tape feed roller 21 and the supplemental tape feed roller 41.

As described above, if all length of the printing tape 3 is supplied from the tape spool 2 because of the production of the character-printed tape, or if another kind of the tape unit is intended to be used even if the present tape unit has not yet been used up, new or another kind of the exchangeable tape unit 1 is to be replaced by the tape spool 2. In this case, first, the tape cassette 10 is taken out from the cassette installing portion, and the cassette lid 12 is removed from the tape cassette body 10 in the above described process. Then, the tape spool 2 is removed from the tape spool accommodating portion 42, and the new exchangeable tape unit 1 is accommodated in the tape spool accommodating portion 42. Then, the printing tape 3 is guided to the tape feed roller 21 via the tape guides 22 through 25 and the recess 18. Thus, assembly of the exchangeable tape unit 1 to the tape cassette body 11 is completed. Next, the cassette lid 12 is assembled to the tape cassette body 11 in the above described process to thus complete assembly of the tape cassette 10. The newly assembled tape cassette 10 is then installed in the cassette installing portion for enabling the subsequent printing operation.

As described above, in the exchangeable tape unit 1 according to the present embodiment, since the heat sensitive coloring layer 6 is radially inwardly positioned in winding the printing tape 3 over the tape spool 2, the heat sensitive layer 6 can be protected against the external heat, light, etc., thereby protecting the heat sensitive layer 6 against color change and quality change. Therefore, the printing tape 3 can be easily stored for a prolonged period of time while maintaining stabilized quality without color change and quality change in the heat sensitive coloring layer 6.

Further, in the exchangeable tape unit 1, the film sheets 4 are affixed to the upper and lower surfaces of the tape roll, and therefore, the printing tape 3 can be approximately perfectly protected against external detriment such as heat, light, etc., by the film sheets and by the internal winding of the heat sensitive layer 6 of the printing tape 3.

While the invention has been described in detail and with reference to the specific embodiment thereof, it would be apparent to those skilled in the art that various changes and modifications may be made therein without departing from the spirit and scope of the invention.

What is claimed is:

1. An exchangeable tape unit, comprising:
- a tape spool; and
- a printing tape wound over the tape spool for providing a tape roll, the printing tape comprising:
- a base tape,
- a heat sensitive coloring layer formed over a first surface of the base tape,
- a first adhesive agent formed over a second surface of the base tape opposite the first surface of the base tape, and
- a peelable tape provided over the first adhesive agent;
- the printing tape being wound over the tape spool, the first surface of the base tape facing the tape spool and the second surface of the base tape facing away from the tape spool, the peelable tape forming an outside surface of the tape roll.

2. The exchangeable tape unit as claimed in claim 1, wherein the tape roll has upper and lower faces, and further comprising film sheets affixed to the upper and lower faces through a second adhesive agent.

3. The exchangeable tape unit of claim 1, wherein a thermal head forms an output image on the heat sensitive coloring layer of the base tape.

4. A tape cassette comprising:
- a tape cassette body having:
  - a bottom wall, a front wall, a rear wall and side walls,
  - a tape spool accommodating portion defined by the bottom, front, rear and side walls, and
  - a top open end defined by the front, rear and side walls;
- a cassette lid covering the top open end of the tape cassette body; and
- an exchangeable tape unit removably disposed within the tape spool accommodating portion, the exchangeable tape unit comprising:
  - a tape spool, and
  - a printing tape wound over the tape spool for providing a tape roll, the printing tape comprising;
    - a base tape,
    - a heat sensitive coloring layer formed over a first surface of the base tape,
    - a first adhesive agent formed over a second surface of the base tape opposite the first surface of the base tape, and
    - a peelable tape provided over the first adhesive agent;
  - the printing tape being wound over the tape spool, the first surface of the base tape facing the tape spool and the second surface of the base tape facing away from the tape spool, the peelable tape forming an outside surface of the tape roll.

5. The tape cassette as claimed in claim 4, wherein the tape cassette body further comprises a plurality of guides for guiding the printing tape, the plurality of guides providing a curved path, wherein the heat sensitive coloring layer of the printing tape faces inwardly of the curved path.

6. The tape cassette as claimed in claim 5, wherein the tape cassette body further comprises a thermal head guide member defining a recess for a thermal head of a tape printer such that a plurality of heat generating elements of the thermal head faces the heat sensitive coloring layer.

7. The tape cassette as claimed in claim 6, wherein the cassette body further comprises:
- a pair of locking projections defining a locking groove on the front wall of the cassette body,
- at least one locking aperture formed in the rear wall of the cassette body, and
- a locking slot formed with the thermal head guide member.

8. The tape cassette as claimed in claim 7, wherein the cassette lid comprises:
- a resilient locking member,
- at least one locking projection and
- a locking piece, wherein the resilient locking member is engageable with the locking groove, the at least one locking projection is engageable with the at least one locking aperture, and the locking piece is engageable with the locking slot, the cassette lid being pivotably movable about the at least one locking aperture during assembly and disassembly of the cassette lid to and from the cassette body.

9. The tape cassette as claimed in claim 4, wherein the tape roll has upper and lower faces, and further comprising film sheets affixed to the upper and lower faces through a second adhesive agent.

10. The tape cassette as claimed in claim 9, wherein the tape cassette body further comprises a plurality of guides for guiding the printing tape, the plurality of guides providing a curved path, the heat sensitive coloring layer of the printing tape facing inwardly of the curved path.

11. The tape cassette as claimed in claim 10, wherein the tape cassette body further comprises a thermal head guide member defining a recess for a thermal head of a tape printer such that a plurality of heat generating elements of the thermal head faces the heat sensitive coloring layer.

12. The tape cassette as claimed in claim 11, wherein the cassette body comprises:
- a pair of locking projections defining a locking groove,
- at least one locking aperture formed in the rear wall of the cassette body, and
- a locking slot formed with the thermal head guide member.

13. The tape cassette as claimed in claim 12, wherein the cassette lid comprises:
- a resilient locking member,
- at least one locking projection and
- a locking piece, wherein the resilient locking member is engageable with the locking groove, the at least one locking projection is engageable with the at least one locking aperture and the locking piece is engageable with the locking slot, the cassette lid being pivotably movable about the at least one locking aperture during assembly and disassembly of the cassette lid to and from the cassette body.

14. The tape cassette of claim 4, wherein a thermal head forms an output image on the heat sensitive coloring layer of the base tape.

* * * * *